US005611192A

United States Patent [19]

Weder

[11] Patent Number: 5,611,192

[45] Date of Patent: Mar. 18, 1997

[54] APPARATUS FOR DISPENSING AND WRAPPING A SHEET OF MATERIAL ABOUT A FLOWER POT OR FLORAL GROUPING

[75] Inventor: Donald E. Weder, Highland, Ill.

[73] Assignee: Southpac Trust International, Inc., Oklahoma City, Okla.

[21] Appl. No.: 473,913

[22] Filed: Jun. 7, 1995

[51] Int. Cl.[6] ..... B65B 11/00

[52] U.S. Cl. ..... 53/221; 53/390; 53/592; 53/219

[58] Field of Search ..... 53/389.3, 390, 53/399, 464, 592, 218, 219, 221

[56] References Cited

U.S. PATENT DOCUMENTS

| | | | |
|---|---|---|---|
| Re. 21,065 | 5/1939 | Copeman . | |
| 732,889 | 7/1903 | Paver . | |
| 1,446,563 | 2/1923 | Hughes . | |
| 1,525,015 | 2/1925 | Weeks . | |
| 1,863,216 | 6/1932 | Wordingham . | |
| 1,978,631 | 10/1934 | Herrlinger . | |
| 2,048,123 | 7/1936 | Howard . | |
| 2,170,147 | 8/1939 | Lane . | |
| 2,218,293 | 10/1940 | Muller | 53/221 |

(List continued on next page.)

FOREIGN PATENT DOCUMENTS

| | | |
|---|---|---|
| 2610604 | 8/1988 | France . |
| 345464 | 2/1917 | Germany . |

OTHER PUBLICATIONS

"The Simple Solution For Those Peak Volume Periods", Highland Supply Speed Cover® Brochure, 1989©, 4 pages.

"Speed Sheets® And Speed Rolls", Highland Supply Speed Sheets® Brochure, 1990©, 2 pages.

*Primary Examiner*—Daniel Moon
*Attorney, Agent, or Firm*—Dunlap & Codding, P.C.

[57] ABSTRACT

A container and jig assembly for dispensing a sheet of material and for wrapping the sheet of material about a flower pot or floral grouping. The container accommodates a roll of sheet material suitable for wrapping flower pots or floral groupings. In addition, the container may have a cutter for separating a sheet of material from the roll of sheet material. The jig assembly is attached to the container and has a jig opening surrounded by a sheet-supporting surface. The jig opening is sized and shaped to receive a lower portion of a flower pot or a stem end portion of a floral grouping. In operation, a sheet of material is separated from the roll of sheet material and disposed on the sheet-supporting surface over the jig opening. The lower portion of the flower pot or the stem end portion of the floral grouping is inserted through the jig opening and carries a portion of the sheet of material with it. In the process, the sheet of material is formed into a covering about the flower pot or floral grouping.

6 Claims, 9 Drawing Sheets

U.S. PATENT DOCUMENTS

| | | | |
|---|---|---|---|
| 2,278,673 | 4/1942 | Savada et al. . | |
| 2,302,259 | 11/1942 | Rothfuss . | |
| 2,355,559 | 8/1944 | Renner . | |
| 2,371,985 | 3/1945 | Freiberg . | |
| 2,411,328 | 11/1946 | McNab . | |
| 2,510,120 | 6/1950 | Leander . | |
| 2,529,060 | 11/1950 | Trillich . | |
| 2,621,142 | 12/1952 | Wetherell . | |
| 2,822,287 | 2/1958 | Avery . | |
| 2,846,060 | 8/1958 | Yount . | |
| 2,850,842 | 9/1958 | Eubank, Jr. . | |
| 2,883,262 | 4/1959 | Borin . | |
| 3,022,605 | 2/1962 | Reynolds . | |
| 3,121,647 | 2/1964 | Harris et al. . | |
| 3,130,113 | 4/1964 | Silman . | |
| 3,271,922 | 9/1966 | Wallerstein et al. . | |
| 3,508,372 | 4/1970 | Wallerstein et al. . | |
| 3,531,910 | 10/1970 | Snead | 53/221 X |
| 3,620,366 | 11/1971 | Parkinson . | |
| 3,681,105 | 8/1972 | Milutin et al. . | |
| 3,793,799 | 2/1974 | Howe et al. . | |
| 4,054,697 | 10/1977 | Reed et al. . | |
| 4,118,890 | 10/1978 | Shore . | |
| 4,216,620 | 8/1980 | Weder et al. . | |
| 4,280,314 | 7/1981 | Stuck . | |
| 4,297,811 | 11/1981 | Weder . | |
| 4,300,312 | 11/1981 | Weder . | |
| 4,333,267 | 6/1982 | Witte . | |
| 4,380,564 | 4/1983 | Cancio et al. . | |
| 4,413,725 | 11/1983 | Bruno et al. . | |
| 4,546,875 | 10/1985 | Zweber . | |
| 4,640,079 | 2/1987 | Stuck . | |
| 4,733,521 | 3/1988 | Weder et al. . | |
| 4,765,464 | 8/1988 | Ristvedt . | |
| 4,989,396 | 2/1991 | Weder et al. | 53/399 X |
| 5,001,885 | 3/1991 | Borella | 53/464 X |
| 5,105,599 | 4/1992 | Weder | 53/399 |
| 5,205,108 | 4/1993 | Weder et al. | 53/399 X |
| 5,291,721 | 3/1994 | Weder et al. | 53/390 X |
| 5,473,858 | 12/1995 | Hayes | 53/390 X |

APPARATUS FOR DISPENSING AND WRAPPING A SHEET OF MATERIAL ABOUT A FLOWER POT OR FLORAL GROUPING

FIELD OF THE INVENTION

The present invention relates generally to materials for wrapping objects and, more particularly, but not by way of limitation, to a sheet of material for covering portions of an object wherein a pressure sensitive adhesive is on a portion of the sheet of material.

DETAILED DESCRIPTION OF PREFERRED EMBODIMENTS

Figure 1:
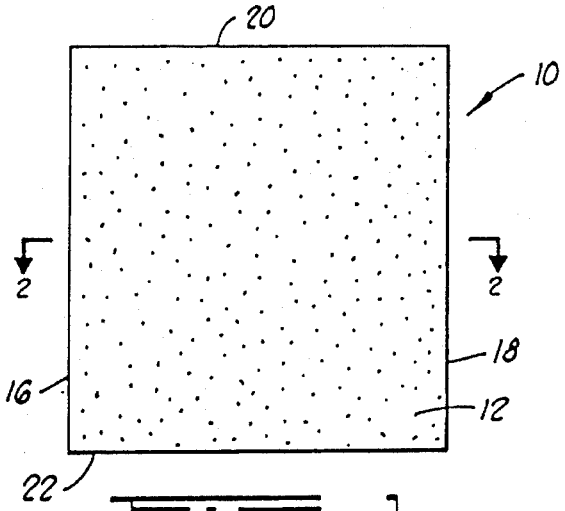
FIG. 1 is a top plan view of a sheet of material constructed in accordance with the present invention.
Figure 2:
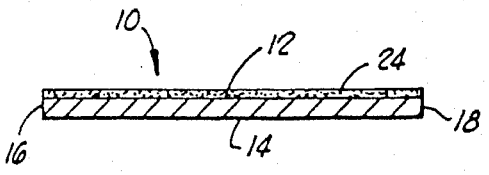
FIG. 2 is a sectional view of the sheet of material shown in FIG. 1 taken substantially along the lines 2—2 of FIG. 1.

Referring to the drawings in FIGS. 1 and 2 in particular, shown therein and designated by the general reference numeral 10 is a sheet of material constructed in accordance with the present invention. The sheet of material 10 has an upper surface 12, a lower surface 14, a first side 16, and an opposed second side 18 spaced a distance from the first side 16, a first end 20 and an opposed second end 22 spaced a distance from the first end 20. The sheet of material 10 shown in FIG. 1 is generally square or rectangular shaped; however, the sheet of material 10 could be circularly shaped or any other configuration desired in a particular application.

The sheet of material 10 is a relatively thin sheet of material having a thickness in the range of from less than about 1.0 mils to about 2.5 mils. The upper limit on the thickness may vary depending on the type of material. The upper limit on the thickness is set such that the material retains sufficient flexibility and fold ability so that the material easily can be shaped by hand about the object to be covered. As a practical matter, the upper limit is about 20 mils. The sheet of material is constructed of any one of the materials selected from a group of materials comprising paper, foil cellophane or processed organic polymer films or combinations thereof.

In one preferred embodiment, the sheet of material is constructed from a relatively thin film of a non-shape sustaining processed organic polymer film. The term "processed organic polymer film" as used herein means a manmade resin such as polypropylene as opposed to naturally occurring resins such as cellophane. A processed organic polymer film is relatively strong and not as readily subject to tearing (substantially non-tearable when used to cover portions of an object) as might be paper or foil. The processed organic polymer film is a substantially linearly linked processed organic polymer film and is a synthetic linear chain organic polymer where the carbon atoms are substantially linearly linked. Such films are synthetic polymers formed or synthesized from monomers. Further, a relatively substantially linearly linked processed organic polymer film is virtually waterproof which may be desirable in many applications which is not true of an untreated paper, for example, unless the paper is treated with a water resistant coating or impregnated with a water resistant material or by laminating the paper. It also should be noted that some papers such as long fiber papers are substantially resistant to tearing (substantially non-tearable when used to cover an object). In addition, a relatively thin film of a substantially linearly linked processed organic polymer does not substantially deteriorate in sunlight.

A decorative pattern such as a solid color and/or an embossed pattern (not shown) and/or other decorative surface ornamentation is applied to the upper and/or lower surfaces 12 or 14 in one preferred embodiment.

As shown in FIG. 2, a pressure sensitive adhesive 24 is applied to the upper surface 12 of the sheet of material 10 and, in the embodiment shown in FIGS. 1 and 2, the pressure sensitive adhesive 24 covers substantially the entire upper surface 12 of the sheet of material 10, the thickness of the pressure sensitive adhesive 24 being greatly exaggerated in FIG. 2. In some embodiments, the pressure sensitive adhesive 24 may cover only preselected portions of the upper surface 12 of the sheet of material. The pressure sensitive adhesive may be any substance, inorganic or organic, natural or synthetic, that is capable of bonding to other surfaces or to other surfaces coated with a like pressure sensitive adhesive. The tack level of the pressure sensitive adhesive should be controlled in most applications so that the sheet of material does not destroy or substantially damage the object bonded thereto when removed from the object or does not destroy any decorative pattern which is applied to the upper and lower surface 12 or 14 when unbonded.

The term "pressure sensitive adhesive" as used herein includes those adhesives mentioned before and it is utilized by the application of a slight pressure such as might be imposed by the hand of an individual for example, as opposed to those adhesives requiring chemical activators or heat to be bondable. Pressure sensitive adhesives and the controlling of the tack level of such pressure sensitive adhesives are well known in the art and a detailed description of such pressure sensitive adhesives is not deemed necessary herein.

Figure 3:
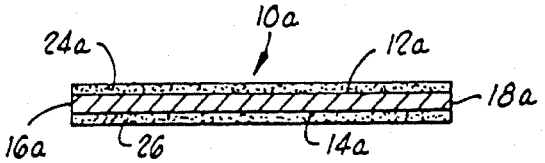
FIG. 3 is a cross sectional view, similar to FIG. 2, but showing a modified sheet of material constructed in accordance with the present invention.

Embodiment of FIG. 3

Shown in FIG. 3 is a modified sheet of material 10*a* which is constructed exactly like the sheet of material 10 shown in FIGS. 1 and 2 and described in detail before, except the sheet of material 10*a* includes a pressure sensitive adhesive 26 applied to the lower surface 14*a* of the sheet of material 10*a* in addition to the pressure sensitive adhesive 24*a* applied to the upper surface 12*a* of the sheet of material 10*a*. The pressure sensitive adhesive 26 is exactly like the pressure sensitive adhesive 24 described before. In some applications, it may be desirable to have both the pressure sensitive adhesive 24*a* applied to the upper surface 12*a* of the sheet of material 10*a* as well as the pressure sensitive adhesive 26 applied to the lower surface 14*a* of the sheet of material 10*a*, the thicknesses of the pressure sensitive adhesives 24*a* and 26 being greatly exaggerated in FIG. 3. The pressure sensitive adhesive 26, as shown in FIG. 3, substantially covers the entire lower surface 14*a* of the sheet of material 10*a*, although it could be applied only to selected portions of the sheet of material.

Figure 4:
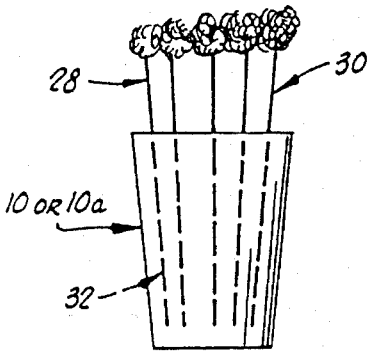
FIG. 4 is a diagrammatic view of a floral grouping having either the sheet of material shown in FIGS. 1 and 2 or the sheet of material shown in FIG. 3 wrapped about a portion thereof.

Embodiment of FIG. 4

Shown diagrammatically in FIG. 4 is one use of the sheet of material in FIGS. 1 and 2 or the sheet of material 10*a* shown in FIG. 3. A floral grouping 28 is diagrammatically shown in FIG. 4 and the floral grouping 28 generally has a lower end portion 32 comprising mostly the stem portion of the flowers illustrated in FIG. 4 and the upper end portion 30 of the floral grouping 28 comprising the flower end of the flowers diagrammatically shown in FIG. 4. The term "floral grouping" as used herein means arrangements of cut, fresh flowers, artificial flowers and other fresh and/or artificial plants and such arrangements may include other secondary plants which add to the aesthetics of the overall floral grouping.

The sheet of material 10 or 10*a* is wrapped about the lower end portion 32 of the floral grouping 28 so portions of the sheet of material overlap and the overlapping portions are bonded together by contacting the pressure sensitive adhesive 24 on the sheet of material 10 or 10*a* with adjacent overlapping portions of the sheet of material 10 or 10*a* by contacting the pressure sensitive adhesive 24 and/or 24*a* and 26 on the upper and lower surface 12 or 12*a* or 14 or 14*a* with adjacent overlapping portions of the sheet of material 10 or 10*a* so that the sheet of material 10 or 10*a* substantially encompasses the lower end portion 32 of the floral grouping 28 and is secured thereabout by the bonding of the overlapping portions of the sheet of material 10 or 10*a*.

Utilizing the sheet of material 10 or 10*a*, when an individual purchases the floral grouping 28 such as diagrammatically shown in FIG. 4, the seller simply takes the sheet of material 10 or 10*a*, wraps the sheet of material 10 or 10*a* about the lower end portion 32 of the floral grouping 28 and the sheet of material 10 or 10*a* is secured about the lower end portion 32 of the floral grouping 28 by the bonding of the overlapping portions of the sheet of material 10 or 10*a* as described before. Thus, the sheet of material 10 or 10*a* provides an easy and convenient means for wrapping the lower end portion 32 of the floral grouping 28 and, utilizing the sheet of material 10 or 10*a*, the sheet of material 10 or 10*a* is secured in place wrapped about the lower end portion 32 of the floral grouping 28 without requiring any additional means for securing the sheet of material in the wrapped position about the lower end portion 32 of the floral grouping 28. The sheet of material 10 or 10*a* preferably is a foil, cellophane or a processed organic polymer film in this application.

Figure 5:
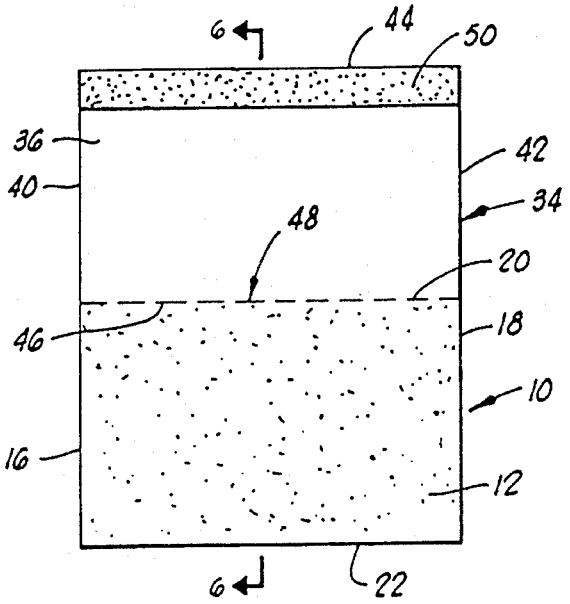
FIG. 5 is a top plan view of another modified sheet of material constructed in accordance with the present invention.
Figure 6:
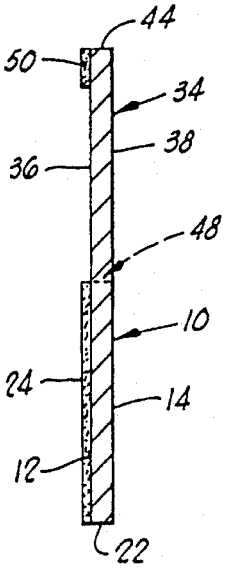
FIG. 6 is a cross sectional view of the modified sheet of material shown in FIG. 5, taken substantially along the lines 6—6 of FIG. 5.

Embodiment of FIGS. 5 and 6

Shown in FIGS. 5 and 6 is the sheet of material 10 having a sheet extension 34 secured to the first end 20 thereof. More particularly, the sheet extension 34 includes an upper surface 36, a lower surface 38, a first side 40, a second side 42, a first end 44 and a second end 46. The second end 46 of the sheet extension 34 is secured to the first end 20 of the sheet of material 10 and the second end 46 of the sheet extension 34 extends substantially along the entire length of the first end of the sheet of material 10 generally between the first and the second sides 16 and 18 of the sheet of material. As shown in FIGS. 5 and 6, a line of perforations 48 is formed along the connection between the second end 46 of the sheet extension 34 and the first end 20 of the sheet of material 10 for reasons which will be made more apparent below. The sheet of material 10 preferably has a decorative pattern (such as a color and/or an embossed pattern) and/or other decorative surface ornamentation on the upper surface 12 and/or the lower surface 14, as mentioned before.

A pressure sensitive adhesive 50 is applied to the upper surface 36 of the sheet extension 34. The pressure sensitive adhesive 50 extends generally between the first side 40 and the second side 42 and extends a distance generally from the first end 44 of the sheet extension 34 generally toward the second end 46. Although the pressure sensitive adhesive 50 is shown in FIG. 5 applied only to the upper surface 36, it should be noted that a similar pressure sensitive adhesive may be applied to the lower surface 38 of the sheet extension 34 generally opposite the pressure sensitive adhesive 50. Also, it should be noted that the sheet of material 10*a* equally could be utilized in the embodiment of the invention shown in FIGS. 5 and 6.

Figure 7:
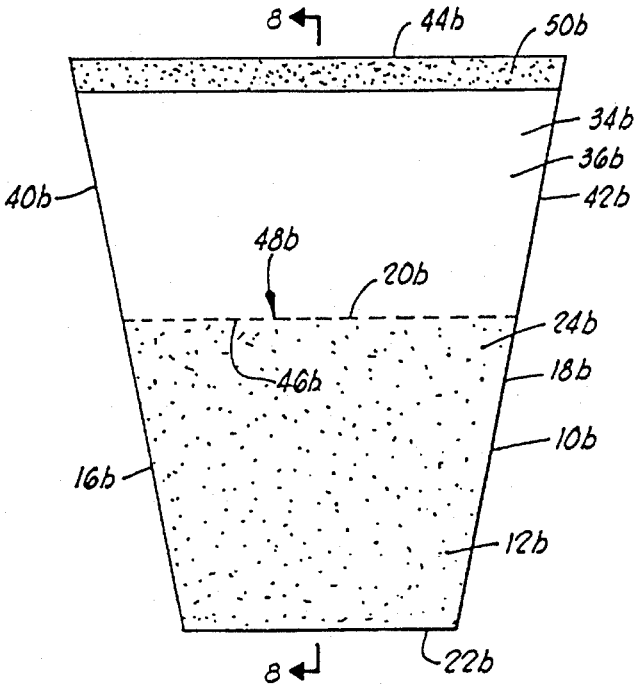
FIG. 7 is another modified sheet of material constructed in accordance with the present invention.
Figure 8:
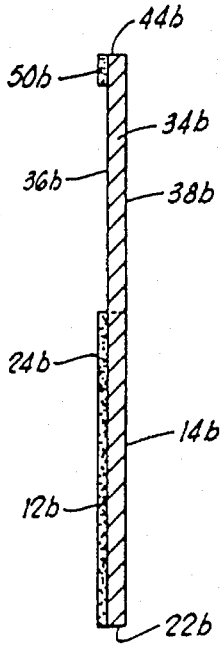
FIG. 8 is a sectional view of the modified sheet of material shown in FIG. 7 taken substantially along the lines 8—8 of FIG. 7.

Embodiment of FIGS. 7 and 8

Shown in FIG. 7 is a modified sheet of material 10*b* which is constructed exactly like the sheet of material 10, except the first and the second sides 16*b* and 18*b* each are tapered inwardly generally from the first end 20*b* toward the second end 22*b* so the length of the first end 20*b* generally between the first and the second sides 16*b* and 18*b* is generally longer than the length of the shorter second end 22*b* generally between the first and the second sides 16*b* and 18*b*.

A modified sheet extension 34*b* is connected to the first end 20*b* of the sheet of material 10*b*. The sheet extension 34*b* is constructed exactly like the sheet extension 34 shown in FIGS. 5 and 6 and described in detail before, except the first and the second sides 40*b* and 42*b* each are tapered inwardly generally from the first end 44*b* toward the second end 46*b*. When the sheet extension 34*b* is connected to the sheet of material 10*b*, the first side 16*b* of the sheet of material 10*b* is generally aligned with the first side 40*b* of the sheet extension 34*b* and the taper of the first side 16*b* is substantially the same as the taper of the first side 40*b* so the first sides 16*a* and 40*b* are aligned and taper inwardly generally from the first end 44*b* of the sheet extension 34*b* generally toward the second end 22*b* of the sheet of material 10*b* so the length of the first end 44*b* of the sheet extension 34*b* generally between the first and the second sides 40*b* and 42*b* is generally longer than the length of the second end 22*b* of the sheet of material 10*b* generally between the first and the second sides 16*b* and 18*b* of the sheet of material 10*b*. A line of perforations 48*b* is formed along the connection between the second end 46*b* of the sheet extension 34*b* and the first end 20*b* of the sheet of material 10*b*.

The pressure sensitive adhesive 50*b* is applied on the upper surface 36*b* generally near the first end 44*b* of the sheet extension 34*b*. The pressure sensitive adhesive 50*b* extends generally between the first side 40*b* and the second side 42*b* and extends a distance from the first end 44*b* generally toward the second end 46*b*. Although the pressure sensitive adhesive 50*b* is shown only on the upper surface 36*b* of the sheet extension 34*b*, a similar pressure sensitive adhesive strip may be applied to the lower surface 38*b* of the sheet extension 34*b* generally opposite the pressure sensitive adhesive 50*b*. Also, a modified sheet of material 10*a* could be utilized in lieu of the sheet of material 10*b* in the embodiment of the invention shown in FIGS. 7 and 8.

Figure 9:
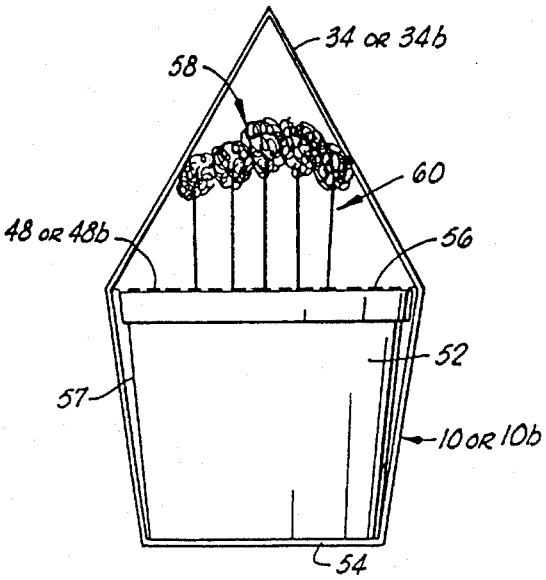
FIG. 9 is a diagrammatic view of a flower pot having a floral grouping supported or disposed therein with the sheet of material shown in FIG. 5 wrapped about a portion of the flower pot and the floral grouping.

Embodiment of FIG. 9

Shown in FIG. 9 is a flower pot 52 having a substantially closed lower end 54, and an open upper end 56 and an outer peripheral surface 57. The flower pot 52 is adapted to receive portions of a floral grouping within an opening formed generally between the lower end 54 and the open upper end 56 and to support such a floral grouping with a portion of the floral arrangement extending generally outwardly from the open upper end 56. The term "floral grouping" as used in this context means a potted plant or flower, although a flower pot could be utilized to hold cut fresh flowers or cut plants or artificial flowers if one so desired.

Flower pots of the type described before in connection with the flower pot 52 are common and well known in the art and a detailed description of such a flower pot is not deemed necessary herein.

Also, diagrammatically shown in FIG. 9 is a floral grouping 58 having an upper end portion 60 and a lower end portion (not shown in FIG. 9. The floral grouping 58 is similar to the floral grouping 28 described before in connection with FIG. 4. However, the lower end portion of the floral grouping 58 is disposed in the flower pot 52 and the flower pot 52 together with the contents of the flower pot 52, such as soil or other support means, cooperates to support the floral grouping 58 in an upright position with the upper end portion 60 of the floral grouping 58 extending outwardly from the open upper end 56 of the flower pot 52 and extending a distance generally above the open upper end 56 of the flower pot 52.

Utilizing either the sheet of material 10 shown in FIGS. 5 and 6 or the sheet of material 10*b* shown in FIGS. 7 and 8, the individual places the sheet of material about the flower pot 52 so that the pressure sensitive adhesive 24 or 24*b* on the upper surface 12 or 12*b* is disposed generally adjacent the outer peripheral surface 57 of the flower pot 52 and the individual wraps the sheet of material 10 or 10*b* about the outer peripheral surface 57 of the flower pot 52, the individual pressing the sheet of material 10 or 10*b* against the outer peripheral surface 57 so that the pressure sensitive adhesive 24 or 24*b* contacts and bonds to the outer peripheral surface 57. The individual wraps the sheet of material 10 or 10*b* about the entire outer peripheral surface of the flower pot 52 and bonds the sheet of material 10 or 10*b* to the outer peripheral surface 57 of the flower pot 52 by way of the pressure sensitive adhesive 24*a* thereby bonding the sheet of material 10 or 10*b* to the outer peripheral surface 57 of the flower pot 52. The sheet of material 10 or 10*b* has a width extending generally between the first end and the second end so that the sheet of material 10 or 10*b* extends about the entire outer peripheral surface 57 and generally between the closed lower end 54 and the open upper end 56 of the flower pot 52, the line of perforations 48 or 48*b* being disposed generally adjacent or extending a distance generally above the open upper end 56 of the flower pot 52 when the sheet of material 10 or 10*b* has been wrapped about the outer peripheral surface 57 of the flower pot 52. After the sheet of material 10 or 10*b* has been wrapped about and bonded to the outer peripheral surface 57 of the flower pot 52, the sheet extension 34 or 34*b* extends a distance above the open upper end 56 of the flower pot 52 and the height of the sheet extension 34 or 34*b* extending generally between the first end 44 or 44*b* and the second end 46 or 46*b* is sufficient so that the sheet extension 34 or 34*b* extends generally above the upper end portion 60 of the floral grouping 58. The individual then wraps the sheet extension 34 or 34*b* generally about the upper end portion 60 of the floral grouping 58, portions of the first end 44 or 44*b* of the sheet extension 34 or 34*b* being overlapped. The individual then secures the first end 44 or 44*b* in a sealed or closed position by bonding the overlapping portions of the first end 44 or 44*b* of the sheet extension 34 or 34*b* with the bonding occurring as a result of the pressure sensitive adhesive 50 or 50*b* contacting the adjacent overlapping portions of the sheet extension 34 or 34*b* generally near the first end 44 or 44*b*. In this position of the sheet of material 10 or 10*b* with the sheet extension 34 or 34*b* attached thereto, the sheet extension 34 or 34*b* substantially encompasses and surrounds the upper end portion 60 of the floral grouping 58.

The sheet of material 10 or 10*b* preferably includes a decorative pattern, as mentioned before, and thus the outer peripheral surface 57 of the flower pot 52 substantially is covered with a decorative covering provided by the sheet of material 10 or 10*b*. Further, in the assembled position of the sheet of material 10 or 10*b* about the outer peripheral surface 57 of the flower pot 52, the floral grouping 58 remains protected since the floral grouping 58 is covered by the sheet extension 34 or 34*b*, yet the floral grouping 58 remains substantially exposed for displaying the floral grouping 58 since the sheet extension 34 or 34*b* substantially is clear (see through).

The sheet extension 34 or 34*b* can be removed from the sheet of material 10 or 10*b* attached thereto by an individual purchaser by breaking the bond at the first end 44 or 44*b* formed by the pressure sensitive adhesive 50 or 50*b* and tearing the sheet extension 34 or 34*b* from the sheet of material 10 or 10*b* connected thereto generally along the line of perforations 48 or 48*b*. After the sheet extension 34 or 34*b* has been removed from the sheet of material 10 or 10*b*, the sheet 10 or 10*b* remains bonded or connected to the outer peripheral surface 57 of the flower pot 52 to provide a decorative covering for the flower pot 52.

The sheet extension 34 or 34*b* preferably is constructed from the same materials mentioned before with respect to the sheet of material 10, 10*a* or 10*b* and preferably, the sheet extension 34 or 34*b* and the sheet of material are constructed of the processed organic polymer film, although the sheet of material also could be constructed of a foil or cellophane or paper. Thus, the sheet of material 10 or 10*b* substantially is waterproof, thereby preventing leakage from the flower pot 52 from escaping through the sheet of material 10 or 10*b*. Further, since the sheet extension 34 or 34*b* is substantially waterproof, the sheet extension 34 or 34*b* cooperates to retain moisture within the area enclosed by the sheet extension 34 or 34*b*, the sheet extension 34 or 34*b* cooperating with the sheet of material 10 or 10*b* to retain moisture thereby cooperating to retain the freshness of the floral grouping when the floral grouping consists of either fresh cut flowers or fresh growing flowers.

It should be noted that, in the embodiment shown in FIG. 9, the sheet of material 10 or 10*b* has a height generally between the first end 20 or 20*b* and the second end 22 or 22*b* sufficient so that a portion of the sheet of material generally near the second end 22 or 22*b* can be wrapped about the closed lower end 54 of the flower pot 52, the closed lower end 54 comprising a portion of the outer peripheral surface 57 of the flower pot 52. In this embodiment, the sheet of material 10 or 10*b* initially is placed adjacent a portion of the outer peripheral surface 57 of the flower pot 52 with the first end 20 or 20*b* disposed generally near the open upper end 56 of the flower pot 52 and the second end 22 or 22*b* of the sheet of the material 10 or 10*b* extending a distance beyond the closed lower end 54 of the flower pot 52. The sheet of material 10 or 10*b* is then wrapped about the outer peripheral surface 57 with a portion of the sheet of material 10 or 10*b* generally near the second end 22 or 22*b* being formed over the closed lower end 54 of the flower pot 52. Also, it should be noted that the sheet of material 10 or 10*b* without the sheet extension 34 or 34*b* can be applied to the outer peripheral surface 57 of the flower pot 52 to provide a decorative flower pot cover.

In an alternative embodiment, the pressure sensitive adhesive can be applied to the flower pot for adhesively connecting the sheet of material to the flower pot.

Figure 10:
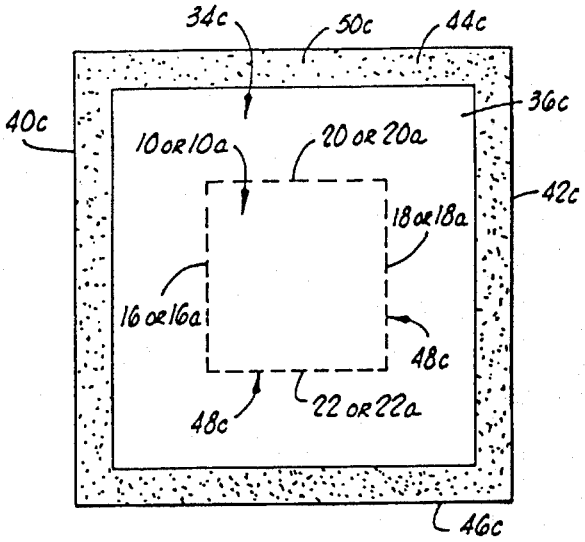
FIG. 10 is a view of another modified sheet of material constructed in accordance with the present invention.

Embodiment of FIG. 10

Shown in FIG. 10 is the sheet of material 10 or 10*a* having another modified sheet extension 34*c* connected thereto. The sheet of material 10 or 10*a* is constructed exactly like the sheet of material 10 or 10*a* described before in connection with FIGS. 1, 2, 3 and 4. The sheet extension 34*c* is generally rectangularly shaped and has a rectangularly shaped opening formed in a central portion thereof, the rectangularly shaped opening formed in a central portion of the sheet extension 34*c* being defined in FIG. 10 by the rectangularly shaped line of perforations 48*c*. The sheet extension 34*c* is connected to the outer peripheral surface of the sheet of material 10 or 10*a* generally at the line of perforations 48*c* so that the sheet extension 34*c* extends outwardly from the first side 16 or 16*a*, outwardly from the second side 18 or 18*a*, outwardly from the first end 20 or 20*a* and outwardly from the second end 22 or 22*a*. A modified pressure sensitive adhesive 50*c* is applied to a portion of the upper surface 36*c* of the sheet extension 34*c*, the pressure sensitive adhesive 50*c* extending about the sheet extension 34*c* generally near the first side 40*c*, the second side 42*c*, the first end 44*c* and the second end 46*c*.

Utilizing the sheet of material 10 or 10*a* with the sheet extension 34*c* connected thereto to cover the flower pot 52 and floral grouping 58 shown in FIG. 9, the flower pot 52 is disposed generally in a central portion of the sheet of material 10 or 10*a* so that the closed lower end 54 of the flower pot 52 is disposed generally adjacent the pressure sensitive adhesive, the closed lower end 54 contacting the pressure sensitive adhesive thereby bonding the closed lower end 54 to a central portion of the sheet of material 10 or 10*a*. An individual then forms the sheet of material 10 or 10*a* upwardly about the outer peripheral surface 57 of the flower pot 52 with the pressure sensitive adhesive being disposed generally adjacent and contacting the outer peripheral surface 57 of the flower pot 52. As the individual forms the sheet of material 10 or 10*a* about the outer peripheral surface 57 of the flower pot 52, the individual presses the sheet of material 10 or 10*a* generally against the outer peripheral surface of the flower pot 52 thereby bonding the sheet of material 10 or 10*a* to the outer peripheral surface 57 of the flower pot 52 by way of the pressure sensitive adhesive. When the sheet of material 10 or 10*a* has been wrapped and bonded about the outer peripheral surface 57 of the flower pot 52, the first side 16 or 16*a*, the second side 18 or 18*a*, the first end 20 or 20*a* and the second end 22 or 22*a* each is disposed generally adjacent or extends a distance above the open upper end 56 of the flower pot 52.

After the sheet of material 10 or 10*a* has been connected to the outer peripheral surface 57 of the flower pot 52, the individual then forms the sheet extension 34*c* generally about the upper end portion 60 of the floral grouping 58 overlapping portions of the sheet extension 34*c* generally near the first side 40*c*, the second side 42*c*, the first end 44*c* and the second end 46*c*, the overlapping portions being bonded or connected together by way of the pressure sensitive adhesive 50*c*. Thus, the sheet of material 10 or 10*a* with the sheet extension 34*c* operates in a manner like that described in connection with FIG. 9 to provide a decorative cover for the flower pot 52 while simultaneously providing a covering for the upper end portion 60 of the floral grouping 58. When it is desired to remove the sheet extension 34*c* from the sheet of material 10 or 10*a*, the individual disconnects the bond formed at the overlapping portions by the pressure sensitive adhesive 50*c* and tears the sheet extension 34*c* from the sheet of material 10 or 10*a* by tearing generally along the line of perforations 48*c*.

Figure 11:
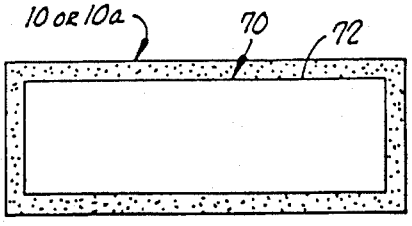
FIG. 11 is a partial view of a package having either the sheet of material shown in FIGS. 1 and 2 or the sheet of material shown in FIG. 3 wrapped about a portion of the package.

Embodiment of FIG. 11

Shown in FIG. 11 is a package 70 which has an outer peripheral surface 72. The sheet of material 10 or 10*a* is shown in FIG. 11 wrapped about the outer peripheral surface 72 of the package 70 (the thickness of the sheet of material 10 or 10*a* being greatly exaggerated in FIG. 11). In this instance, the sheet of material 10 or 10*a* is used as a gift wrapping for the package 70 and thus the sheet of material 10 or 10*a* also includes a decorative pattern, as mentioned before, applied to the upper and/or the lower surface 12 or 12*a* or 14 or 14*a*, the decorative pattern being a color and/or an embossed pattern and/or other pattern or surface ornamentation.

When the sheet of material 10 or 10*a* is utilized as a gift wrapping for the package 70, it is preferable in some applications that the pressure sensitive adhesive 24 and/or 26 be of a type which only will bond to itself. In this instance, when the sheet of material 10 or 10*a* is wrapped about the outer peripheral surface 72 of the package 70, portions of the sheet of material 10 or 10*a* will overlap thereby overlapping portions of the sheet of material 10 or 10*a* having a pressure sensitive adhesive 24 or 26 thereon and the overlapping portions of the sheet of material 10 or 10*a* having the pressure sensitive adhesive 24 or 26 thereon will bond to secure the sheet of material 10 or 10*a* in a wrapped position about the outer peripheral surface 72 of the package 70. The sheet of material 10 or 10*a* will not bond to the outer peripheral surface 72 per se since the pressure sensitive adhesive 24 or 26 is of the type which only will bond to itself. Also, when the sheet of material 10 or 10*a* is utilized as a gift wrapping for packages such as the package 70, it is preferable that the organic polymer film referred to before be used, since this provides a decorative covering and also provides a covering which will not easily tear when wrapped about the outer peripheral surface 72 of the package 70. Also, the sheet of material can be constructed of a foil or paper or cellophane if desired in some applications.

Figure 12:
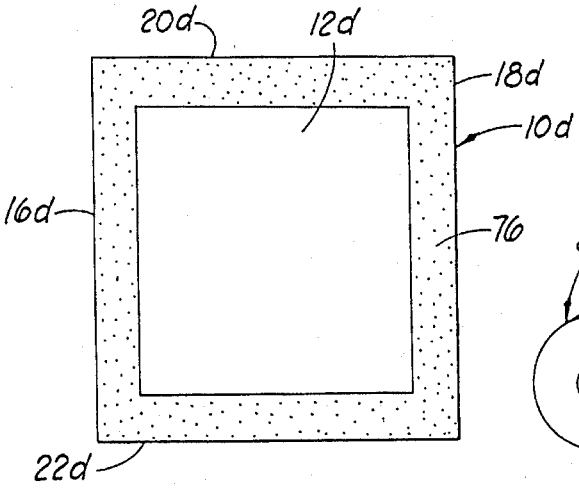
FIG. 12 is a plan view of another modified sheet of material.

Embodiment of FIG. 12

Shown in FIG. 12 is a modified sheet of material 10*d* which is constructed exactly like the sheet of material 10 described before, except the sheet of material 10*d* has a pressure sensitive adhesive 76 applied only to a portion of the upper surface 12*d*, the pressure sensitive adhesive 76 extending generally about the periphery of the sheet of material 10*d* and along the first side 16*d*, the second side 18*d*, the first end 20*d* and the second end 22*d* thereby leaving a substantial portion of the sheet of material 10*d* without any pressure sensitive adhesive applied either to the upper surface 12*d* or the lower surface. This particular pattern may be desired in some applications, such as gift wrapping for packages as described before in connection with FIG. 11 wherein the portion of the sheet of material 10*d* without the pressure sensitive adhesive applied either to the upper surface 12*d* or the lower surface is of a sufficient size to encompass the outer peripheral surface 72 of the package 70 and the overlapping portions generally along the first side 16*d*, the second side 18*d*, the first end 20*d* and the second end 22*d* with the pressure sensitive adhesive 76 applied thereto bond those overlapping portions to secure the sheet of material 10*d* in the wrapped position about the outer peripheral surface 72 of the package 70. Yet, the pressure sensitive adhesive 76 does not contact and bond to the outer peripheral surface.

Figure 13:
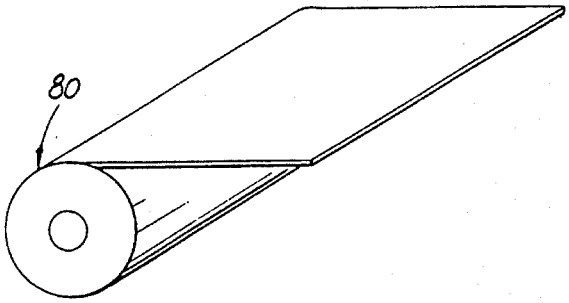
FIG. 13 is a roll of material from which sheets of material constructed in accordance with the present invention may be obtained.

Embodiment of FIG. 13

Shown in FIG. 13 is a roll of material 80 wherein the material in the roll is constructed exactly like the sheet of material 10 or 10*a* described in detail before. In this type of application it is important to control the tackiness of the pressure sensitive adhesive 24 and/or 26 so that the material will be easily released from the roll without destroying or damaging the surface of the adjacent material. In use, an individual would tear sheets of material from the roll of material 80 and the sheets of material torn from the roll of material 80 would operate and would be used in a manner exactly like the sheets of material described before in connection with FIGS. 1 through 12. The roll of material 80 simply provides a convenient means for storing and dispensing material which can be constructed into a plurality of sheets of material by tearing the sheets of material from the roll of material 80.

The roll of material 80, in some applications, includes a plurality of spaced apart lines of perforations. The lines of perforations permit the roll of material to be easily and conveniently torn into sheets of material.

Figure 14:
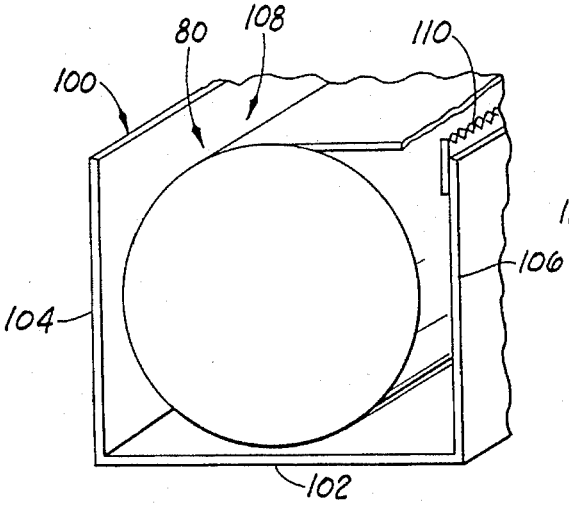
FIG. 14 is a partial perspective view of a container holding a roll of material from which sheets of material constructed in accordance with the present invention may be obtained.

Embodiment of FIG. 14

Shown in FIG. 14 is the roll of material 80 disposed in a container 100, the container 100 having a bottom 102 and opposite sides 104 and 106 encompassing a roll retaining space 108. The roll of material 80, more particularly, is disposed in the roll retaining space 108 in the container 100. The container 100 also has opposite ends (not shown in FIG. 14) connected to the sides 104 and 106 and cooperating with the sides 104 and 106 and the bottom 102 to substantially encompass the roll retaining space 108. The container 100 may also include a lid connected to at least one of the sides 104 or 106 for closing the open upper end of the container 100. A cutter 110 is secured to the upper end of the side 106 and the cutter 110 extends generally along the entire length of the side 106.

In this application, the material is unrolled from the roll of material 80 until the individual has unrolled the desired length of the material and one surface of the material is disposed generally adjacent the cutter 110. The individual then forces the material against the cutter 110 to cut the sheet of material from the roll of material. The sheet of material cut from the roll of material 80 is constructed exactly like the sheets of material described herein and the container 100 simply provides a convenient means for storing the roll of material 80 and dispensing sheets of material therefrom.

The roll of material 80 could include a plurality of lines of perforations for easily and conveniently tearing the sheets of material from the roll of material 80. In this embodiment the cutter 110 could be eliminated.

Figure 15:
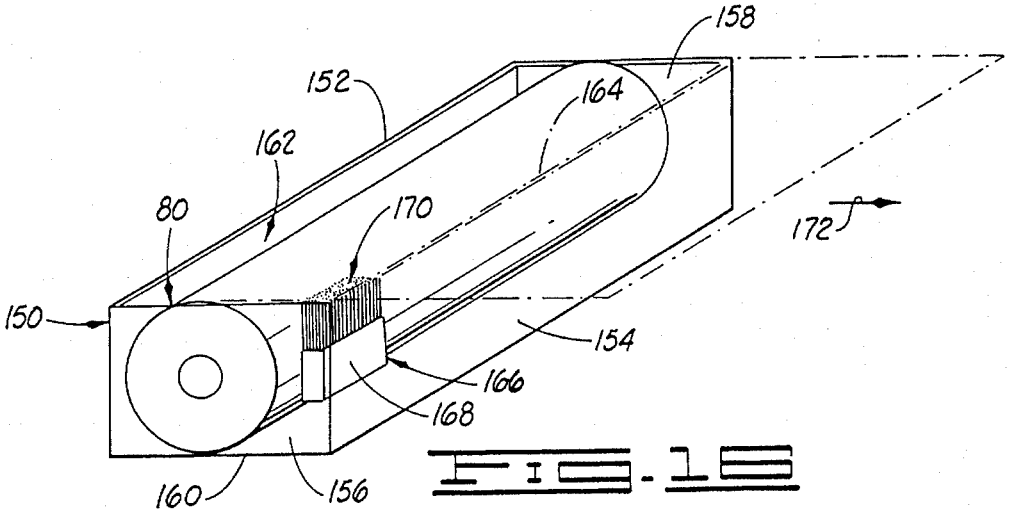
FIG. 15 is a schematic view of another container holding a roll of material from which sheets of material constructed in accordance with the present invention may be obtained.

Embodiment of FIG. 15

Shown in FIG. 15 is another container 120 having a bottom 122 and opposite sides 124 and 126. The bottom 122 and the opposite sides 124 and 126 cooperate with opposite ends (not shown in FIG. 15) to substantially encompass a roll retaining space 128. The roll of material 80 is shown in FIG. 15 disposed in the roll retaining space 128 of the container 120.

A pair of rollers 130 and 132 are rollingly supported on the container 100 generally near the upper end of the side 126 and the rollers 130 and 132 are generally aligned so that the outer peripheral surface of the roller 130 engages the outer peripheral surface of the roller 132 generally along the length of the rollers 130 and 132. The roller 130 is connected to a motor 134 and the motor 134 is adapted to rotate the roller 130 in an activated condition of the motor 134. When the motor 134 is drivingly rotating the roller 130, the roller 132 also is rotated due to the engagement between the outer peripheral surfaces of the rollers 130 and 132. A cutting knife 136 also is supported on the container 120 and the cutting knife 136 is disposed generally above a cutting platform 138 having an opening 140 extending through a portion thereof. The cutting knife 136 is aligned with the opening 140 and the opening 140 is spaced to receive the cutting knife 136 during the operation.

Gear teeth 142 are formed along the portion of the cutting knife 136 and a gear 144 meshingly engages the gear teeth 142. The gear 144 is connected to a motor 146 and, in an activated condition of the motor 146, the motor 146 operates to rotatingly drive the gear 144 thereby moving the cutting knife 136 either in the direction 147 or 148 depending on the direction of rotation of the motor 146. Preferably, the motor 146 is a reversible type of motor so that the motor 146 can drive the gear 144 in both directions of rotation.

It should be noted that, in the embodiment of the invention shown in FIG. 15, only one motor could be utilized in lieu of the two motors 134 and 146 and the single motor could be connected to the rollers 130 and 132 and to the gear 144 with appropriate apparatus and controls for engaging and connecting the motor to either the roller 130 or the gear 144.

In operation, a portion of the material from the roll of material 80 is extended between the outer peripheral surfaces of the two rollers 130 and 132 and the motor 134 is activated to rotatingly drive the rollers 130 and 132 thereby moving the material through the rollers 130 and 132 in a direction 149. The motor 134 drives the rollers 130 and 132 moving the sheet of material in the direction 149 until a predetermined or desired length of material has been moved through the rollers 130 and 132. After the predetermined or desired length of material has been moved through the rollers 130 and 132, the motor 134 is deactivated and the motor 146 is activated to move the cutting knife 136 in the direction 147, a cutting end of the cutting knife 136 engaging the material disposed thereunder and cutting the material as the cutting end portion of the cutting knife 136 moves through the opening 140 of the platform 138. After the material has been cut by the cutting knife 136, the motor 146 is activated to rotate in the opposite direction thereby moving the cutting knife 136 in the upwardly direction 148 and the apparatus shown in FIG. 15 is conditioned to dispense another sheet of material from the roll of material 80.

The sheets of material cut from the roll of material 80 utilizing the apparatus shown in FIG. 15 are constructed exactly like the sheets of material described herein and the apparatus shown in FIG. 15 merely provides a convenient means for storing and dispensing such sheets of material.

Figure 16:
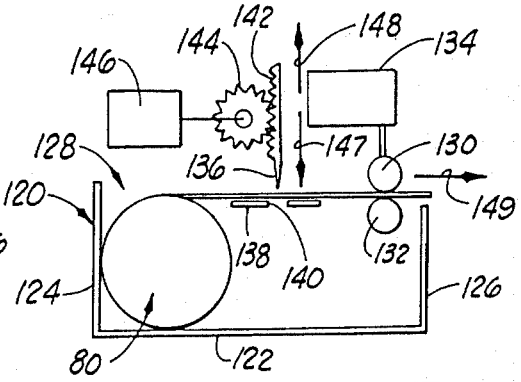
FIG. 16 is a perspective view of another container for holding a roll of material from which sheets of material constructed in accordance with the present invention may be obtained.

Embodiment of FIG. 16

Shown in FIG. 16 is a container 150 having opposite sides 152 and 154, opposite ends (only one end being shown in FIG. 16) and a bottom 160. The sides 152 and 154 cooperate with the ends 156 and 158 and the bottom 160 to encompass a roll retaining space 162. The roll of material 80 is shown in FIG. 16 disposed within the roll retaining space 162, portions of the roll 80 being shown in dash lines in FIG. 16. A cutting edge 164 is formed along the upper end of the side 154 and the cutting edge 164 extends generally along the entire length of the side 154 generally between the opposite ends 156 and 158. The cutting edge 164 is constructed exactly like the cutting edge 110 described before in connection with FIG. 14.

A brush applicator 166 is connected to the side 154 of the container 150 generally near the upper end of the side 154 and generally adjacent one end of the container 150. The brush applicator 166 comprises an applicator container 168 having an open upper end and surrounding adhesive reservoir, a quantity of pressure sensitive adhesive being disposed in the adhesive reservoir in the applicator container 168. A plurality of brushes 170 are disposed through the open end of the applicator container 168 and one end of the brushes 170 is disposed in the pressure sensitive adhesive contained in the adhesive reservoir formed in the applicator container 168. The opposite ends of the brushes 170 extend a distance outwardly from the open upper end of the applicator container 168. The applicator container 168 is positioned on the container 150 so that the brushes 170 are positioned near the cutting edge 164 and positioned so that one end portion of the brushes 170 can engage material for applying the pressure sensitive adhesive to such material.

In operation, an individual pulls material from the roll of material 80 outwardly through the open upper end of the container 150, the brushes 170 engaging and applying pressure sensitive adhesive generally along one side of the material as the material is being unrolled from the roll of material 80. The individual then pulls the material in a direction 172 until the individual has pulled a predetermined or desired amount of the material from the roll of material 80, the pressure sensitive adhesive being applied to one surface of the material generally along one edge of the material as the material is being unrolled from the roll of material 80 and pulled in the direction 172. After the individual has moved the material in the direction 172 until a desired length of material has been removed from the roll of material 80, the individual then tears the material generally along the cutting edge 164 thereby forming a sheet of material constructed in accordance with the present invention and having pressure sensitive adhesive on one surface thereof generally along one edge thereof which was applied by the brushes 170 as the material was being removed from the roll of material.

It should be noted that the brushes 170 could extend generally along the entire length of the upper edge of the side 152 generally between the opposite ends of the container 150 for applying pressure sensitive adhesive across substantially the entire surface of the material as the material is being removed from the roll of material 80. Also, a duplicate set of brushes and another applicator container could be disposed near the opposite end so that a strip of pressure sensitive adhesive is applied to both sides of the material as the material is being passed over the two brushes if desired in some applications.

Also, it should be noted that brushes like the brushes 170 may be used with an applicator container like the applicator container 120 shown in FIG. 15 for applying adhesive to the material as the material is being unrolled from the roll of material 80.

In one other embodiment, the rubber rollers 130 and 132 each are adapted to apply pressure sensitive adhesive to the material as it is being moved through the rollers 130 and 132 thereby applying pressure sensitive adhesive to both sides of the sheet of material as the material is being moved in the direction 149 through the rollers 130 and 132 or, in an alternative embodiment, only one of the rollers 130 and 132 can be adapted to apply pressure sensitive adhesive to the adjacent surface of the material as the material is being moved in the direction 149 through the rollers 130 and 132 thereby applying pressure sensitive adhesive to either the upper or the lower surface of the material depending on whether the roller 130 or 132 is adapted to apply the pressure sensitive adhesive.

It also should be noted that the adhesive could be applied with a spray applicator. Also, a dip coating system or a static depositing system could be utilized to apply the adhesive.

Figure 17:
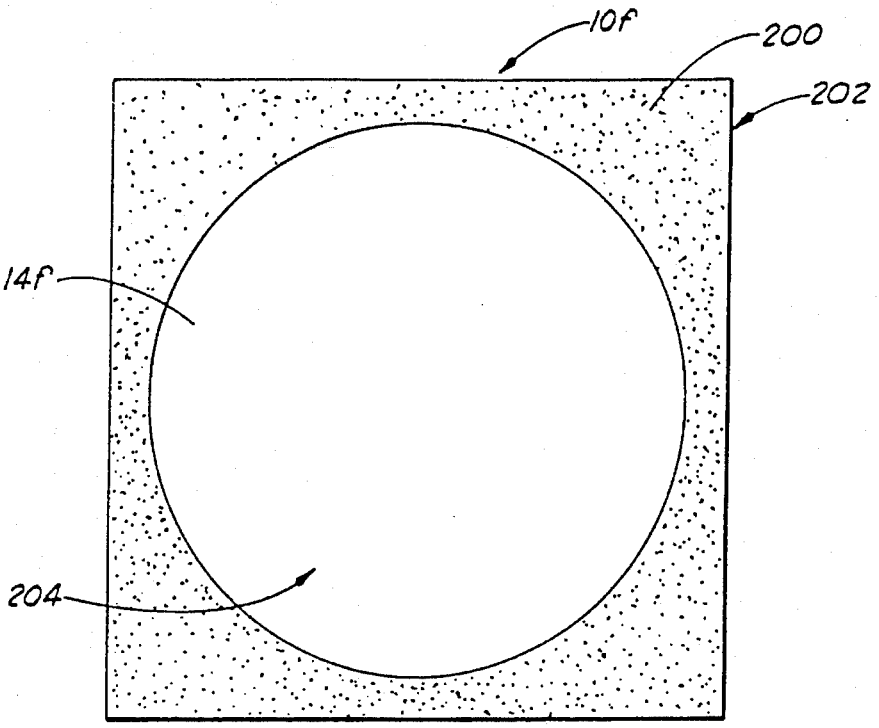
FIG. 17 is a plan view of the lower surface of another modified sheet of material constructed in accordance with the present invention.
Figure 18:
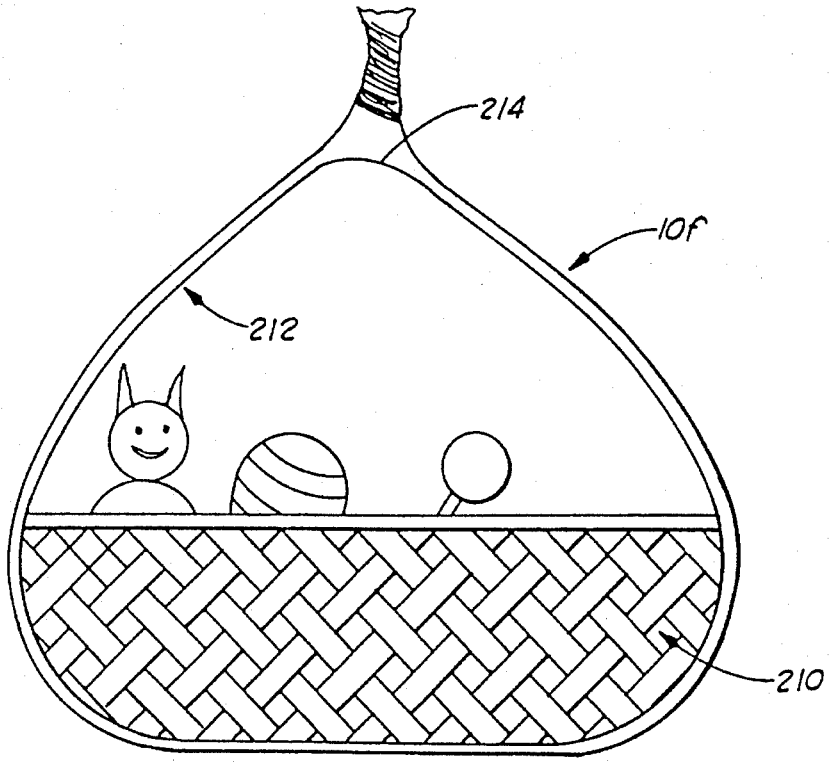
FIG. 18 is a side elevational view of an Easter basket covered with the sheet of material shown in FIG. 17.

Embodiment of FIGS. 17 and 18

Shown in FIG. 17 is a modified sheet of material 10*f* which is constructed exactly like the sheet of material described before, except the sheet of material 10*f* includes a pressure sensitive adhesive 200 applied to a portion of the lower surface 14*f* generally adjacent and extending about a peripheral edge 202 thereby leaving a central non-adhesive portion 204 which has no pressure sensitive adhesive. Shown in FIG. 18 is a typical, commercially available Easter basket 210 which includes a handle 212. The handle 212 extends from an open upper end 214 of the Easter basket 210 and provides a grippable extension so an individual can grip the handle 212 and transport the Easter basket 210.

The Easter basket 210 is placed in a central portion of the sheet of material 10*f*, the non-adhesive portion 204. The sheet of material 10*f* then is wrapped over the Easter basket 210 and the handle 212 to a position wherein the peripheral edge 202 of the sheet of material 10*f* is disposed generally above an upper end portion 214 of the handle 212. The portion of the sheet of material 10*f* generally near and including the peripheral edge 202 then is pressed together in a manner bringing together the portions of the sheet of material 10*f* having the adhesive 200 thereon so the portions of the sheet of material 10*f* generally near the peripheral edge 202 are adhesively connected to close the peripheral edge 202 and connect the sheet of material 10*f* about the Easter basket 210 and handle 212. The peripheral edge 202 portion of the sheet of material 10*f* also could be twisted to adhesively connect the portions of the sheet of material near the peripheral edge 202.

Although the basket 210 has been described as an Easter basket, the basket 210 could be a fruit basket or any other type of basket designed to hold items until further, the sheets of material described herein, particularly the sheet of material 10*f*, could be used to wrap other items such as bread. Further, although the sheet of material 10*f* is shown in the drawing as being in a square or rectangular configuration, the sheet of material could be circular or any other appropriate configuration.

Embodiments of FIGS. 19 through 23

Figure 19:
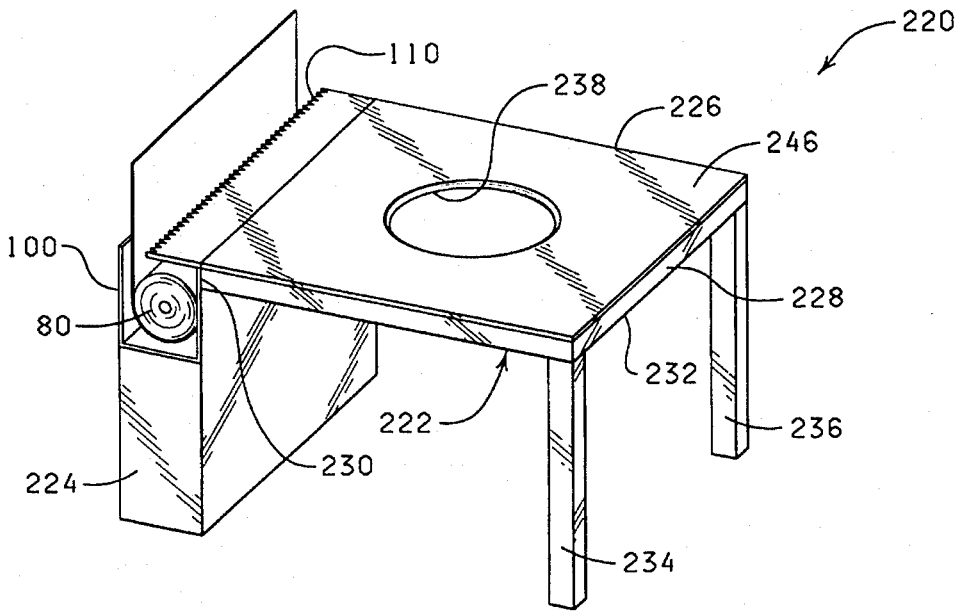
FIG. 19 is a perspective view of an apparatus constructed in accordance with the present invention for dispensing a sheet of material and wrapping the sheet of material about a flower pot.

With reference to FIG. 19, shown therein and designated by reference numeral 220 is an apparatus constructed in accordance with the present invention for dispensing a sheet of material and wrapping the sheet of material about a flower pot. The apparatus 220 includes the dispenser or container 100, roll 80 of sheet material and a jig assembly 222.

The dispenser or container 100 is substantially the same as that shown in FIG. 14 and disclosed hereinabove, but is oriented with the cutter 110 in a horizontal position rather than a vertical position. With this orientation, the sheet of material is pulled up and across the cutter 110 rather than across and down on the cutter 110. The container 100 is supported on any suitable base 224.

Figure 23:
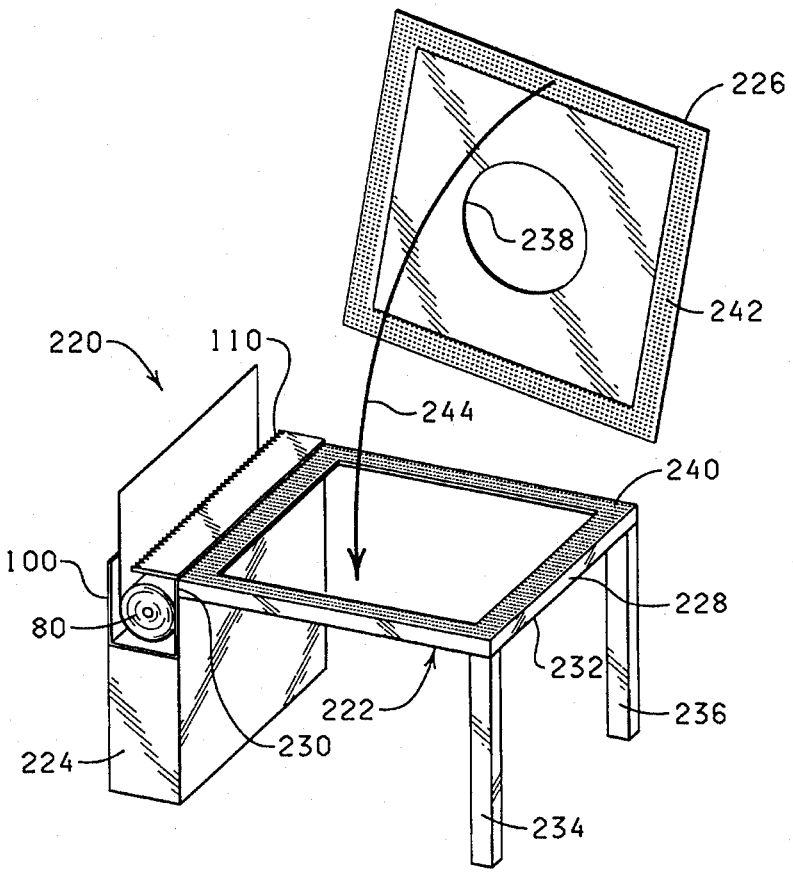
FIG. 23 is a partly diagrammatic perspective view of another embodiment of the apparatus shown in FIG. 19. This embodiment has a removable jig plate.

As best seen in FIG. 23, the jig assembly 222 comprises a jig 226 and a jig stand 228. The jig stand 228 has one side 230 attached to the container 100 and an opposite side 232 supported by a pair of legs 234 and 236.

The jig 226 is basically a plate having a centrally located jig opening 238. The jig opening 238 is sized to accommodate the particular size of flower pot to be wrapped with a sheet of material.

As illustrated by FIG. 23, at least a portion of the upper surface of the jig stand 228 is provided with hook and latch material 240, such as that known under the name "VELCRO." The jig 226 has an underside with a complementary hook and latch material 242.

With the jig 226 placed on the jig stand 228, as indicated by arrow 244, the areas of hook and latch material 240 and 242 engage one another to removably secure the jig 226 to the upper surface of the jig stand 28. Further, the hook and latch areas 240 and 242 allow very easy changing of jigs to accommodate various sizes of flower pots or floral groupings.

Alternatively, the position of the jig 226 on the jig stand 228 may be maintained with screws, bolts, lugs, magnets or any suitable manner known in the art. It should also be appreciated that the jig 226 and jig stand 228 may be rigidly connected together or may be constructed or molded as one piece.

Figure 20:
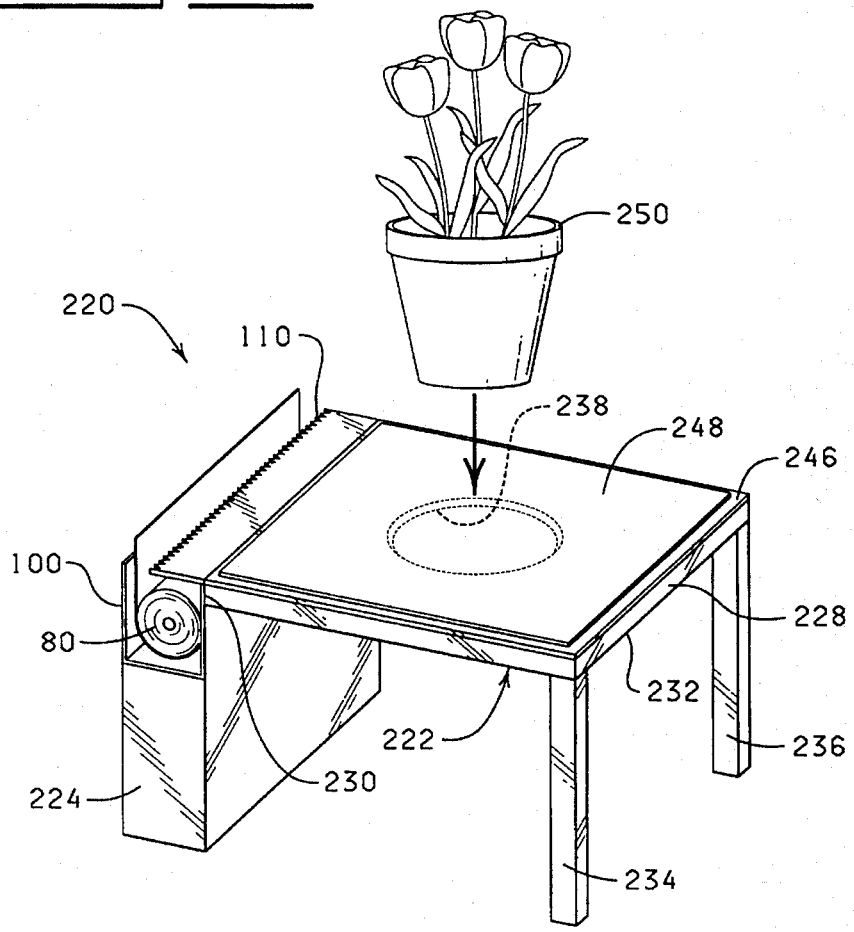
FIG. 20 is the same view as FIG. 19, but shows a sheet of material in place for wrapping and a flower pot being disposed on the sheet of material.
Figure 21:
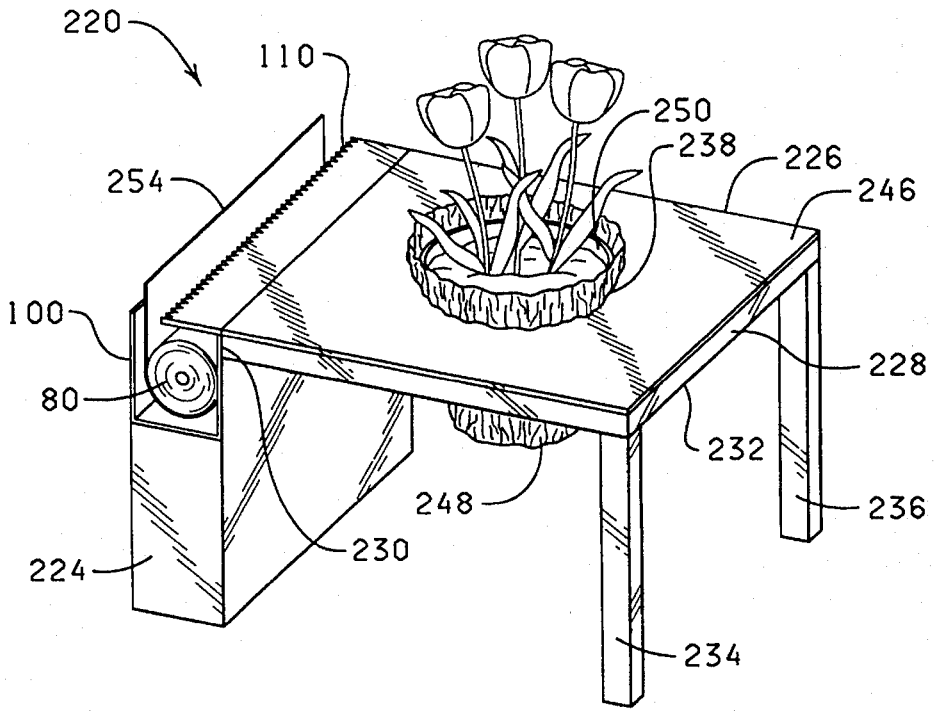
FIG. 21 is the same view as FIG. 19, but shows the sheet of material wrapped about the flower pot.

As shown in FIGS. 19 and 20, the jig 226 has an upper surface 246 which has dimensions for accommodating a sheet of material 248 suited for wrapping a flower pot 250 of a predetermined size and shape. The upper surface 246 of the jig 226 may be made of polypropylene, wood, metal or any substance known in the art which is unlikely to damage the sheet of material 248 when placed in frictional contact with the sheet of material. An elastomeric ring or the like may be provided around the circumference of the jig opening 238 to protect the sheet of material 248 from damage as the sheet of material 248 is pushed through the jig opening 238.

Use of the apparatus 220 to wrap a flower pot is best understood with reference to FIGS. 19 through 22. First, the free end 254 of the roll 80 is grasped and pulled upward until an appropriate length of sheet material 248 is unrolled from the roll 80. Then, the unrolled portion of the sheet material is brought across the jig 226 against the cutter 110 to cut off an individual sheet of material 248 from the roll 80.

At this point, the separated sheet of material 248 is disposed on the jig 226 substantially as shown in FIG. 20. Next, the flower pot 250 is lowered onto the sheet of material 248 at the location of the jig opening 238.

The flower pot 250 is disposed through the jig opening 238 with the sheet of material 248 being pushed through the jig opening 238 with the flower pot 250. It should be appreciated that the jig opening 238 is sized and shaped such that at least a lower portion, but not all, of the flower pot 250 fits through the jig opening 238. Thus, the flower pot 250 comes to rest in a position similar to that illustrated by FIG. 21.

Figure 22:
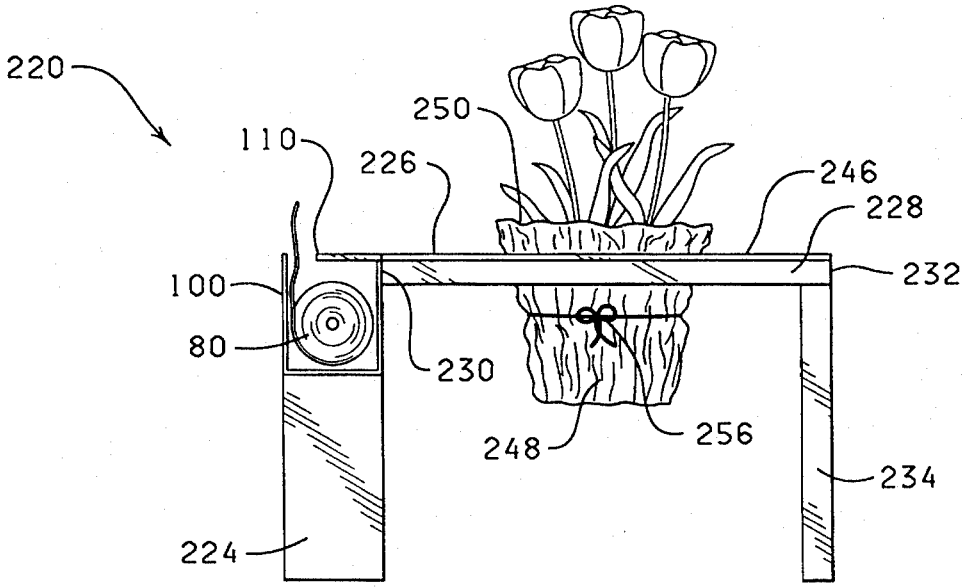
FIG. 22 is a side view of the apparatus as shown in FIG. 21 and illustrates a tie secured around the sheet of material.

In this position, a band, strap or ribbon 256 may be placed around the sheet of material 248 and flower pot 250, substantially as shown in FIG. 22. It should be appreciated that the legs 234 and 236 of the jig stand 228 and the base 224 supporting the container 100 cooperate to elevate the flower pot 250 to a position allowing easy access for application of the ribbon 256.

The ribbon 256 applied to the sheet of material 248 and flower pot 250 may be elastic, semi-elastic or inelastic. Any known means for securing the ribbon 256 may be utilized, such as by tying, gluing, stapling, hooking, riveting, buckling, "VELCRO-ing" or the like. Further, the ribbon 256 may be secured about the sheet of material 248 and flower pot 250 in any decorative manner.

It should be appreciated that adhesive or cohesive areas of the sheet of material 248 may be provided to hold the sheet of material 248 in the flower pot covering shape after the sheet of material 248 has been pushed through the jig opening 238 by the flower pot 250. It should also be appreciated that the flower pot 250 and formed sheet of material 248 may be removed from the jig opening 238 before applying decorative articles, such as the ribbon 256.

Embodiments of FIGS. 24 through 27

Figure 24:
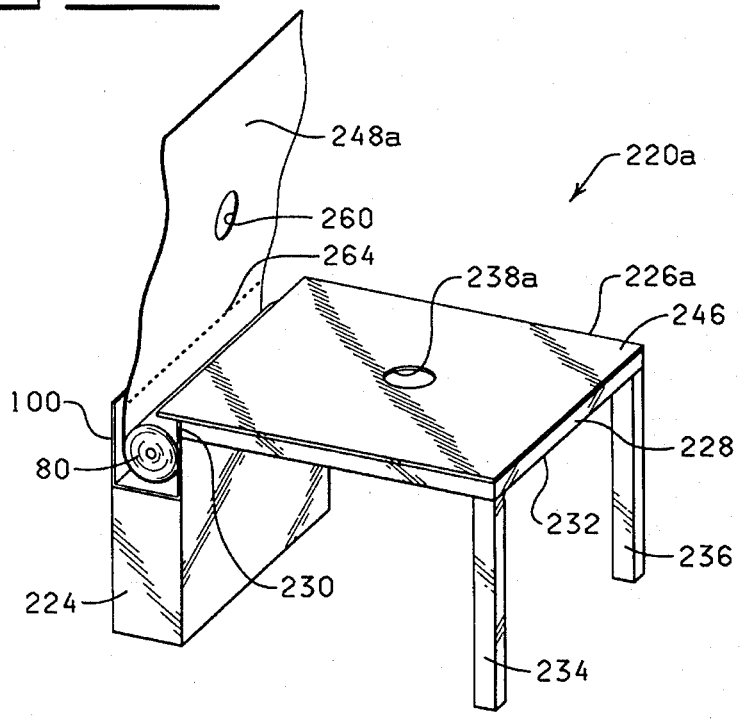
FIG. 24 is a perspective view of another embodiment of the apparatus shown in FIG. 19. This embodiment includes a roll of perforated sheets with pre-cut openings for receiving a floral grouping.

With reference to FIGS. 24 through 27, shown therein and designated by reference character 220*a* is another embodiment of an apparatus for dispensing and wrapping sheets of material. The apparatus 220*a* is adapted for wrapping a floral grouping 258 rather than a flower pot. As shown in FIG. 24, the jig 226*a* employed to wrap a floral grouping typically has a smaller jig opening 238*a* than a jig used for wrapping a flower pot.

Further, the sheets of material 248*a* making up the roll 80 typically have a centrally located hole 260 for receiving an end portion of the stems 262 of the floral grouping. A preferred construction for such sheets is disclosed in U. S. Pat. No. 5,205,108 issued Apr. 27, 1993 to Weder et al., which is hereby incorporated by reference.

As shown in FIG. 24, the sheets of material 248*a* of the roll 80 may be perforated such that there is a perforation 264 between the sheets of material 248*a*. Thus, the sheets of material 248*a* may be separated from the roll 80 by tearing the perforations 264 rather than by using the cutter 110.

Figure 25:
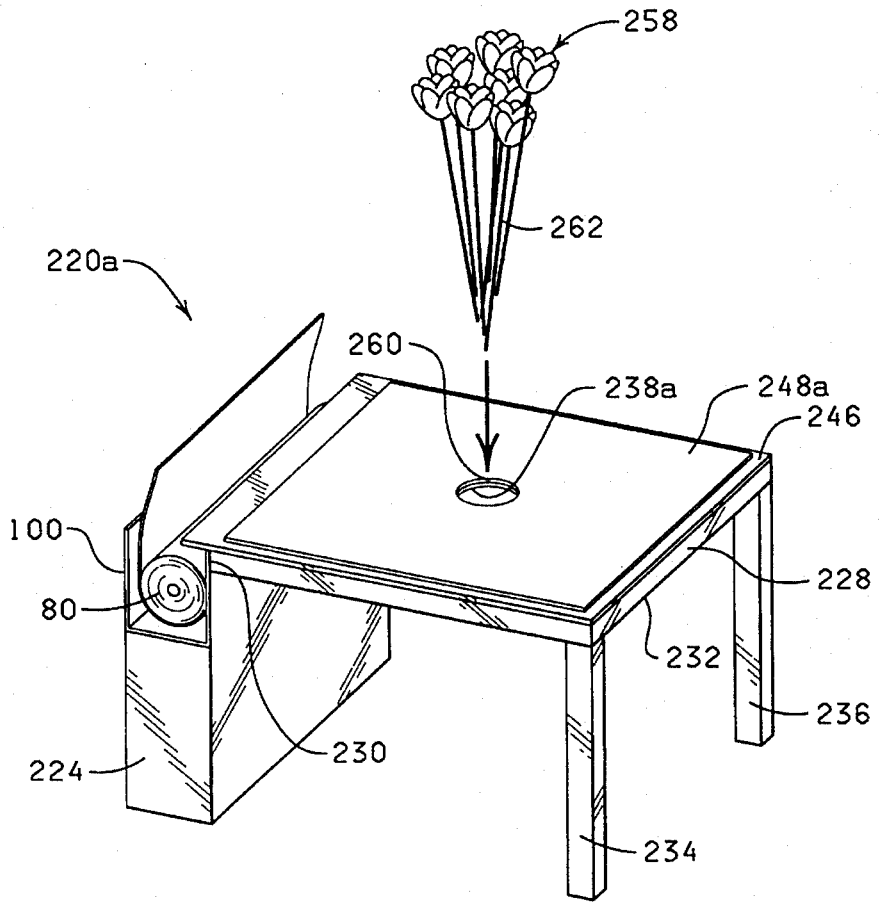
FIG. 25 is the same view as FIG. 24, but shows a sheet of material in place for wrapping a floral grouping.

In order to wrap a floral grouping 258, the end sheet of material 248*a* is separated from the roll 80 and disposed on the upper surface of the jig 226*a* with the hole 260 of the sheet 248*a* aligned with the jig opening 238*a*, substantially as shown in FIG. 25. Then, an end portion of the stems 262 of the floral grouping 258 is inserted through the hole 260 of the sheet of material 248*a* and the jig opening 238*a*.

It should be appreciated that hole 260 of the sheet of material 248*a* is smaller than the jig opening 238*a*. With this construction, the stems 262 of the floral grouping 258 engage the sheet of material 248*a* rather than the jig 226*a* as the stems are inserted into the hole 260 of the sheet of material 248. In this manner, the stems 262 pull a portion of the sheet of material 248*a* through the jig opening 238*a* as the stems are inserted through the jig opening 238*a*.

Figure 26:
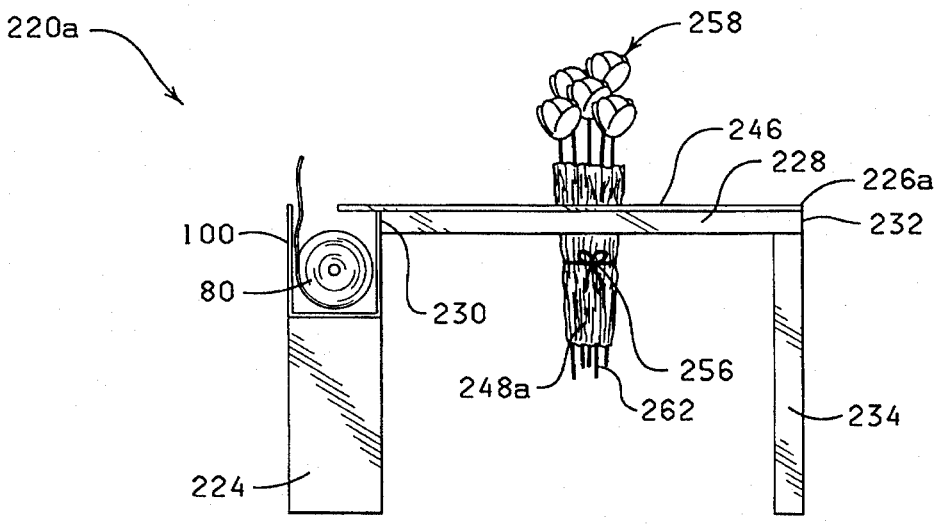
FIG. 26 is an elevational view of the apparatus shown in FIG. 24 illustrating the sheet of material wrapped about the floral grouping.

The jig opening 238*a* is sized such that the sheet of material 248*a* and the floral grouping 258 reach the completed position illustrated by FIG. 26. In this position, the adhesive or cohesive of the sheet of material 248*a*, which may be provided, makes securing contact to maintain the sheet of material 248*a* in the formed shape about the floral grouping. A tie, band, ribbon or the like may easily be applied around the sheet of material 248*a*, substantially as shown in FIG. 26.

The effective diameter of the stems of floral groupings is typically not uniform. Thus, in wrapping floral groupings in particular, it may be desirable to select the suitable size of jig opening for each floral grouping individually.

Figure 27:
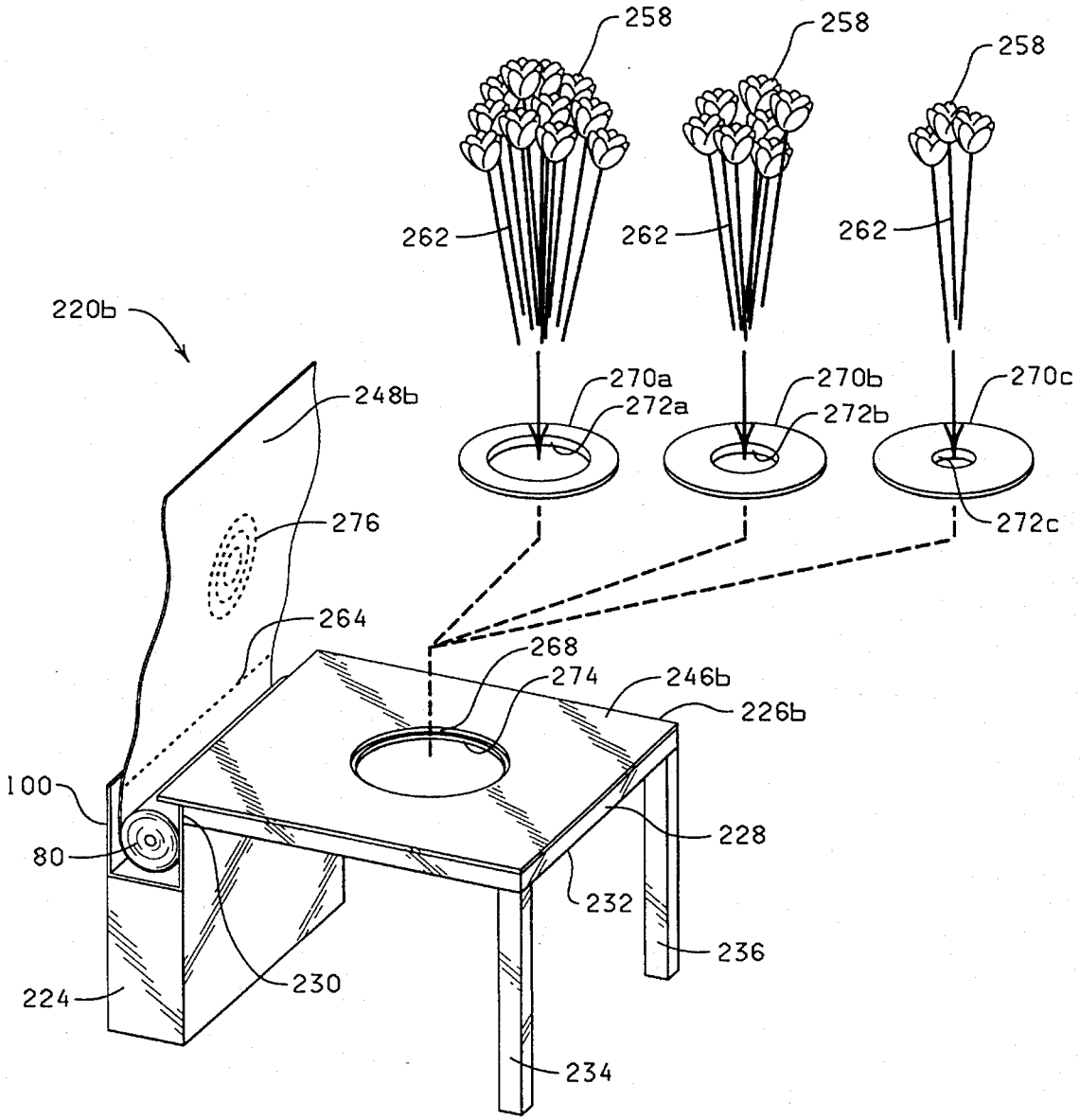
FIG. 27 is a partly diagrammatical perspective view of an alternate embodiment of the apparatus shown in FIG. 25. This embodiment includes removable jig inserts and sheets having concentric perforations for punching out an opening through each sheet for receiving floral groupings of various sizes.

In order to do this, an apparatus 220*b* having a modified jig 226*b* may be provided as illustrated by FIG. 27. The jig 226*b* has a jig opening 268 sized to receive one of a plurality of jig inserts 270*a*, 270*b* and 270*c*. The jig inserts 270*a*, 270*b* and 270*c* all have the same outer dimensions, but have different sized jig insert openings 272*a*, 272*b* and 272*c*, respectively.

The jig opening 268 of the jig 226*b* and the jig inserts 270*a*, 270*b* and 270*c* are constructed such that each one of the jig inserts 270*a*, 270*b* and 270*c* may be matingly retained in the jig opening 268. For example, the jig inserts 270*a*, 270*b* and 270*c* may be disc-shaped and the jig opening 268 may have a flange 274 extending inward to support any one of the jig inserts 270*a*, 270*b* or 270*c*, substantially as shown in FIG. 27.

Alternatively, the jig opening 268 and the outside lateral periphery of the jig inserts 270*a*, 270*b* and 270*c* may be frustoconical such that any one of the jig inserts 270*a*, 270*b* and 270*c* seats into the jig opening 268. In another preferred embodiment, the jig opening 268 and the jig inserts 270*a*, 270*b* and 270*c* may be provided with mating threads such that any one of the jig inserts 270*a*, 270*b* and 270*c* may be screwed into the jig opening 268.

In yet another preferred embodiment, the jig opening 268 and the jig inserts 270*a*, 270*b* and 270*c* may be provided with complementary flanges which intermesh by rotating any one of the jig inserts 270*a*, 270*b* or 270*c* to retain the selected jig insert 270*a*, 270*b* or 270*c* in the jig opening 268. It should be appreciated that various other means known in the art may be utilized to hold the jig insert 270*a*, 270*b* or 270*c* in the jig opening 268.

The sheets of material 248*b* may also be modified for use with floral groupings 258 having various sizes of stems. As illustrated by FIG. 27, each sheet of material 248*a* may have a plurality of centrally located, concentric, circular perforations 276. Alternatively, each sheet of material 248*a* may have a central hole surrounded by a plurality of concentric perforations.

To utilize the apparatus 220*b* for wrapping the floral grouping 258, one of the jig inserts 270*a*, 270*b* and 270*c* having a suitably sized jig insert opening 272*a*, 272*b* or 272*c* is first selected by inserting the stems 262 of the floral grouping 258. If the jig insert opening 272*a*, 272*b* or 272*c* has a diameter for receiving an appropriate length of the stem portion of the floral grouping, then the jig insert is selected for wrapping the floral grouping. If not, then another one of the jig inserts 270*a*, 270*b* and 270*c* is tried for size.

When the jig insert has been selected, the stem end portion of the floral grouping is removed from the jig insert opening 272*a*, 272*b* or 272*c* and the selected jig insert 270*a*, 270*b* or 270*c* is installed in the jig opening 268. The sheet of material 248*b* is disposed on the upper surface of the jig 226*b* with the concentric perforations 276 positioned to be substantially concentric with the jig insert opening 272*a*, 272*b* or 272*c*.

At this point, at least one of the concentric perforations 276 may be broken to produce a hole of appropriate diameter in the sheet of material 248*b*. This may be accomplished by holding the sheet of material 248*b* against the upper surface of the jig 226*b* around the jig insert opening 272*a*, 272*b* or 272*c* and pushing downward on the sheet of material 248*b* within an appropriate one of the concentric perforations 276. Alternatively, the stem end of the floral grouping 258 may used to break the appropriate one of the concentric perforations 276.

The stems 262 of the floral grouping 258 are inserted through the hole in the sheet of material 248*b* and the jig insert opening 272*a*, 272*b* or 272*c*. The stems 262 carry a portion of the sheet of material 248*b* through the jig insert opening 272*a*, 272*b* or 272*c* with them. With the movement of the stem portion of the floral grouping 258 into the jig insert opening 272*a*, 272*b* or 272*c*, the jig 226*b* wraps the sheet of material 248*b* about the floral grouping 258. A band, strap or ribbon may be secured around the floral grouping 258 and wrapped sheet of material 248*b*.

Changes may be made in the various parts, elements and assemblies as described herein or in the steps of the methods described herein or in the sequence of steps of the methods described herein without departing from the spirit and scope of the invention as defined in the following claims.

What is claimed is:

1. An apparatus for wrapping various sized flower pots, the apparatus comprising:

a roll of sheet material;

dispenser means for holding the roll of sheet material and for separating a sheet of material from the roll of sheet material; and a plurality of jigs detachably and interchangeably connectable to the dispenser means, each jig having an upper surface, a lower surface, and a jig opening extending through the upper surface and the lower surface, the jig opening of each jig sized to receive a portion of a flower pot and the jig opening of each jig sized differently than the jig openings of the other jigs such that the plurality of jigs accommodate various sized flower pots, the upper surface of each of the jigs sized to support the sheet of material separated from the roll of sheet material over the jig opening of the jig so that with one of the jigs connected to the dispenser means, at least a portion of one of the flower pots can be disposed on the sheet of material and inserted into the jig opening of the jig connected to the dispenser means with the sheet of material positioned between the flower pot and the jig thereby causing the jig to form the sheet of material about the flower pot.

2. The apparatus of claim 1 further comprising:

a jig stand having one side connected to the dispenser means and an opposite side supported by at least one leg, the jig stand having an upper surface for supporting one of the plurality of jigs.

3. The apparatus of claim 2 further comprising:

connecting means for detachably connecting the lower surface of the jigs to the upper surface of the jig stand.

4. An apparatus for wrapping various sized floral groupings, the apparatus comprising:

a roll of sheet material;

dispenser means for holding the roll of sheet material and for separating a sheet of material from the roll of sheet material;

a jig connected to the dispenser means and having an upper surface, a lower surface, and a jig opening extending through the upper surface and the lower surface; and a plurality of jig inserts, each jig insert configured to be interchangeably retained in the jig opening of the jig and each jig insert having a jig insert opening extending therethrough, the jig insert opening of each jig insert sized to receive a portion of a floral grouping and the jig insert opening of each jig insert sized differently than the jig insert openings of the other jig inserts such that the plurality of jig inserts accommodate various sized floral groupings, the upper surface of the jig sized to support the sheet of material separated from the roll of sheet material over the jig insert opening of the jig insert retained in the jig opening so that with one of the jig inserts retained in the jig opening, at least a portion of one of the floral groupings can be disposed on the sheet of material and inserted into the jig insert opening of the jig insert retained in the jig with the sheet of material positioned between the floral grouping and the jig insert to form the sheet of material about the floral grouping.

5. The apparatus of claim 4 wherein the floral grouping is characterized as having a stem portion and wherein the sheet of material separated from the roll of sheet material has a centrally disposed hole sized to receive a portion of the stem portion of the floral grouping and the centrally disposed hole having a diameter less than the diameter of the jig insert opening of the jig insert retained in the jig.

6. The apparatus of claim 4 wherein the floral grouping is characterized as having a stem portion and wherein the sheet of material separated from the roll of sheet material has a plurality of centrally located, concentric, circular perforations for forming a centrally disposed hole sized to receive a portion of the stem portion of the floral grouping and having a diameter less than the diameter of the jig insert opening of the jig insert retained in the jig.

* * * * *